United States Patent [19]

Julien, Jr.

[11] Patent Number: 4,675,942

[45] Date of Patent: Jun. 30, 1987

[54] HINGE PIN SUPPORT HAVING VARIABLY POSITIONABLE ENTERENGAGING MEMBERS

[75] Inventor: Romeo Julien, Jr., Val d'Or, Canada

[73] Assignee: Les Maisons Quebco Inc., Val d'Or, Canada

[21] Appl. No.: 640,864

[22] Filed: Aug. 15, 1984

[30] Foreign Application Priority Data

Sep. 2, 1983 [CA] Canada ..... 435978

[51] Int. Cl.[4] ..... E05D 5/06

[52] U.S. Cl. ..... 16/384; 16/390

[58] Field of Search ..... 16/384, 387, 388, 389, 16/390, 391, 392

[56] References Cited

U.S. PATENT DOCUMENTS

| | | | |
|---|---|---|---|
| 2,495,962 | 1/1950 | Gravelle et al. | 16/384 |
| 3,439,378 | 4/1969 | Ennis | 16/384 |
| 3,447,198 | 6/1969 | Doerner | 16/390 |
| 4,400,847 | 8/1983 | Farber | 16/387 X |

FOREIGN PATENT DOCUMENTS

| | | | |
|---|---|---|---|
| 45608 | 8/1956 | Fed. Rep. of Germany | 16/384 |
| 489417 | 2/1919 | France | 16/390 |
| 593975 | 10/1947 | United Kingdom | 16/389 |

*Primary Examiner*—Fred Silverberg

*Attorney, Agent, or Firm*—Cushman, Darby & Cushman

[57] ABSTRACT

A hinge pin support for wooden beams having two members which when mounted on opposite sides of a wooden beam can support a hinge pin between them, and which are attached to the beam by a plurality of nail like projections which are formed integrally with each member. The member may also include interengaging projections and grooves for locating the members relative to each other to ensure that the hinge pin support means of the members can be correctly aligned with each other.

14 Claims, 3 Drawing Figures

HINGE PIN SUPPORT HAVING VARIABLY POSITIONABLE ENTERENGAGING MEMBERS

DESCRIPTION

1. Field of the Invention

This invention relates to means for supporting a hinge pin on beams, joists and the like whereby a second beam or the like can be pivotally connected thereto.

2. Description of Prior Art

Hitherto beams, joists and the like have been pivotally connected together by means of hinges which comprise two flat plates secured to the beams, and connected together along parallel adjacent surfaces by a pivot pin which extends through appropriately shaped portions of the plates.

Such hinge plates are connected together prior to their attachment to the beams or the like and where for example the hinge is to be used in building construction it is necessary to provide means for holding the beams accurately and securely relative to each other whilst the hinge is being secured in position.

DISCLOSURE OF THE INVENTION

It is an object of the present invention to provide a hinge pin support and connection means to a beam, joist or the like, which are capable of developing the full shear strenght of the beams, joists and the like being pivotally connected together.

It is another object of the present invention to provide a hinge pin support which can be readily located on and secured to the parts to be hinged together without the necessity of locating and securing the two parts relative to each other.

It is a further object of the invention to provide a hinge pin support which can be used on beams, joists or the like of different size but of the same shape.

BRIEF DESCRIPTION OF THE DRAWINGS

In order that the invention can be understood, and readily carried into effect, and so that the aforementioned objects will become apparent, means in accordance with the invention for supporting a hinge pin on a wooden beam, joists or the like will now be described, by way of example only, with reference to the accompanying drawings, in which.

DESCRIPTION OF A PREFERRED EMBODIMENT

Figure 1:
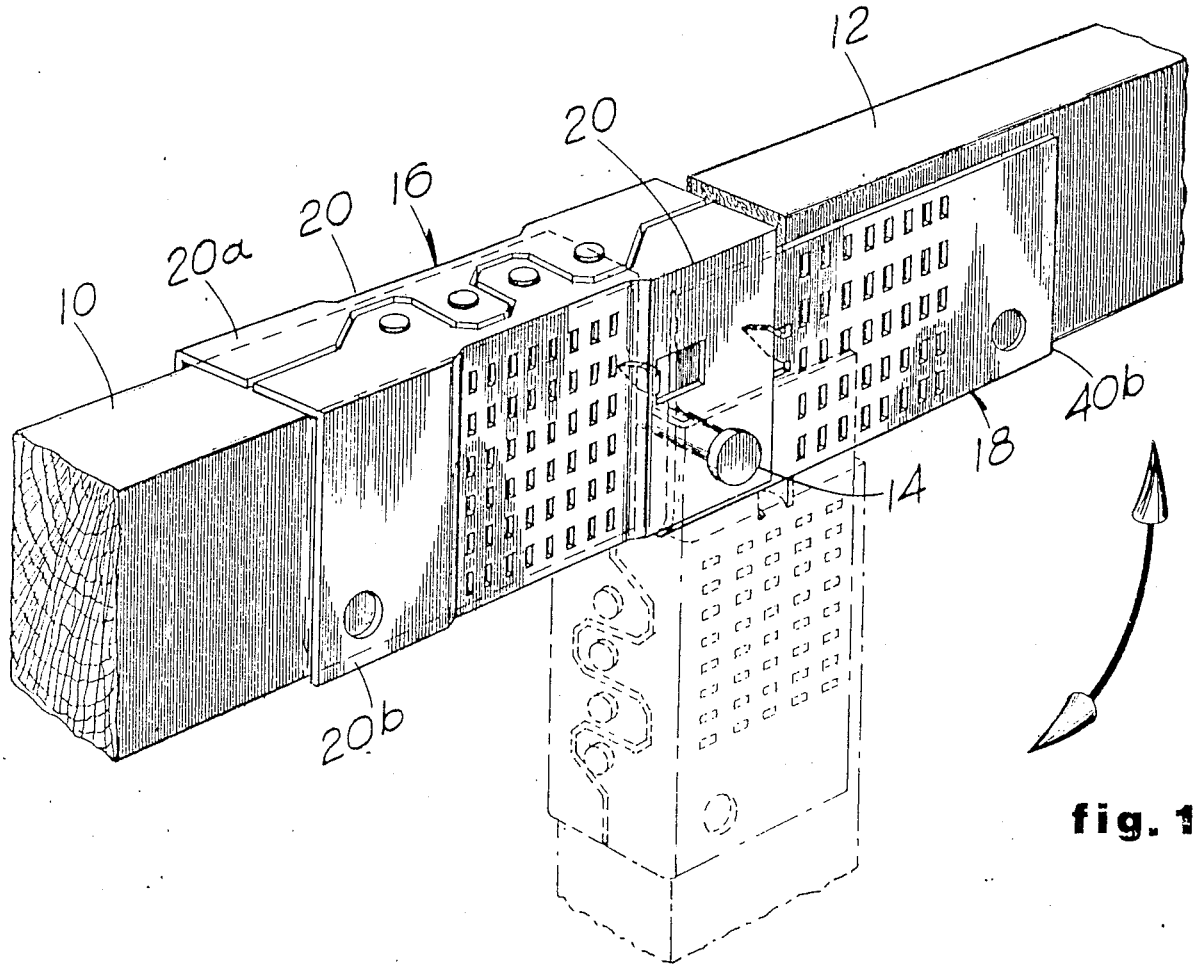
FIG. 1 is a perspective view showing two wooden beams connected together in end to end relationship for relative pivotal movements, by hinge pin support means in accordance with the invention.

Referring to the drawings, two wooden beams 10 and 12, both of which are rectangular in cross-section, are connected together for relative pivotal movements by means of a hinge pin 14 connected between hinge pin support members 16 and 18 mounted respectively on adjacent ends of the beams 10 and 12.

Figure 2:
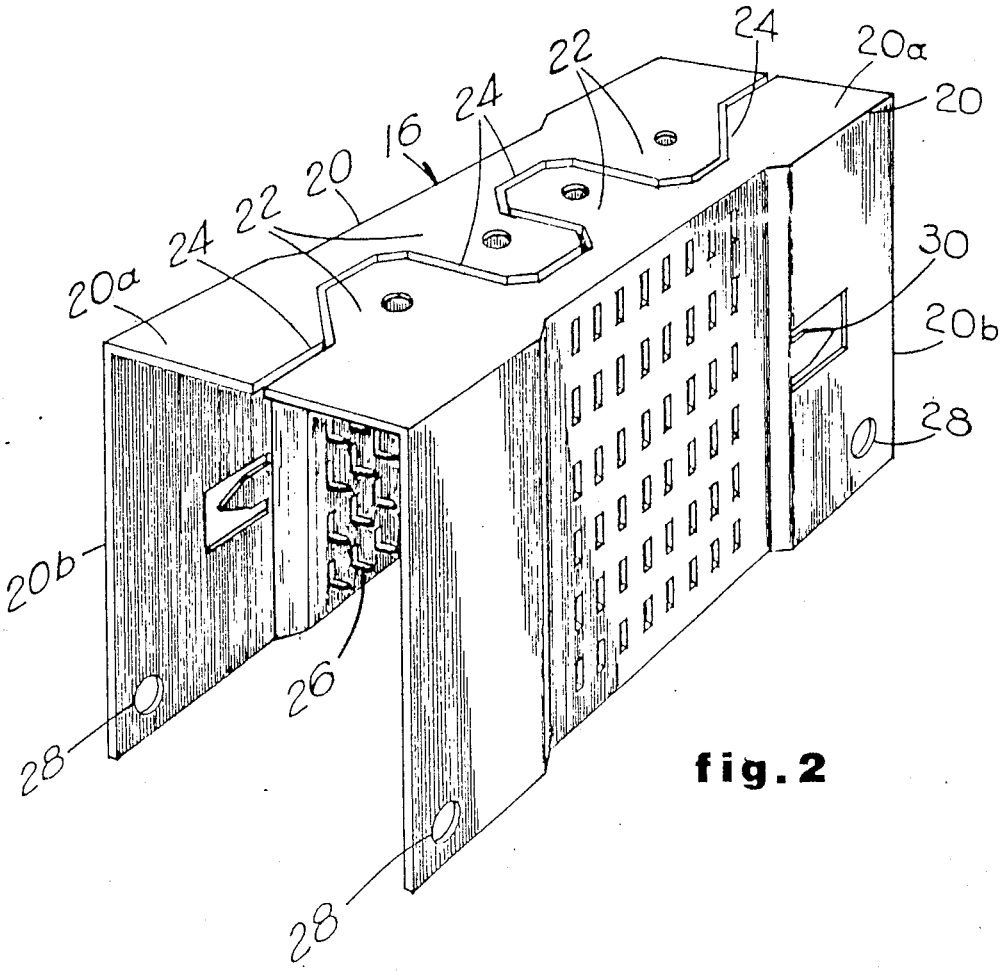
FIG. 2 is a perspective view of one of the hinge pin supports illustrated in FIG. 1.

The hinge pin support member 16, as can be seen from FIG. 2 of the drawings, comprises two parts 20 which are "L" shaped in cross-section, the leg 20*a* of each part being disposed at right angles to the leg 20*b* and extending lengthwise thereof. Alternative projections and recesses 22, 24 are provided in the leg 20*a* of each part 20 and are arranged such that when the two parts are placed together as shown in FIG. 2 the projection 22 on one part will engage in the recesses 24 in the other part.

It will be seen therefore that with the parts 20 so positioned, the parts can be moved transversly of each other, but relative parallel movements will be prevented.

Each part 20 is formed so that the end portions of the leg 20*b* are stepped outwardly relative to the central portion whereby when the parts are placed together as previously described, the distance between the inner faces of the end portion of the legs 20*b* is greater than the distance between the inner faces of the center positions.

A plurality of nail like projections 26 are formed on the center portion of each part 20 and are directed inwardly of the part into an area bounded by the legs 20*a*, 20*b*. The projections are formed integrally with the associated part in a manner well known to those silled in the art of producing gang nails, that is plates which have nail like projections formed thereon which are employed to interconnect or reinforce abutting faces of pieces of timber. Two holes 28 are formed in the leg 20*b* of each part 20, the holes being identically located one at each end of the part adjacent to the end of the leg 20*b* remote from the leg 20*a*.

A tab 30 is provided on one end portion of each part 20 and is disposed between the hole 28 and the central portion. The tab 30 is formed integrally with the part 20 by punching out a section of the part 20 having the shape of the tab 30. Thus the tab can be moved to a position where it projects laterally of the leg 20*b* in the direction of the leg 20*a*.

Figure 3:
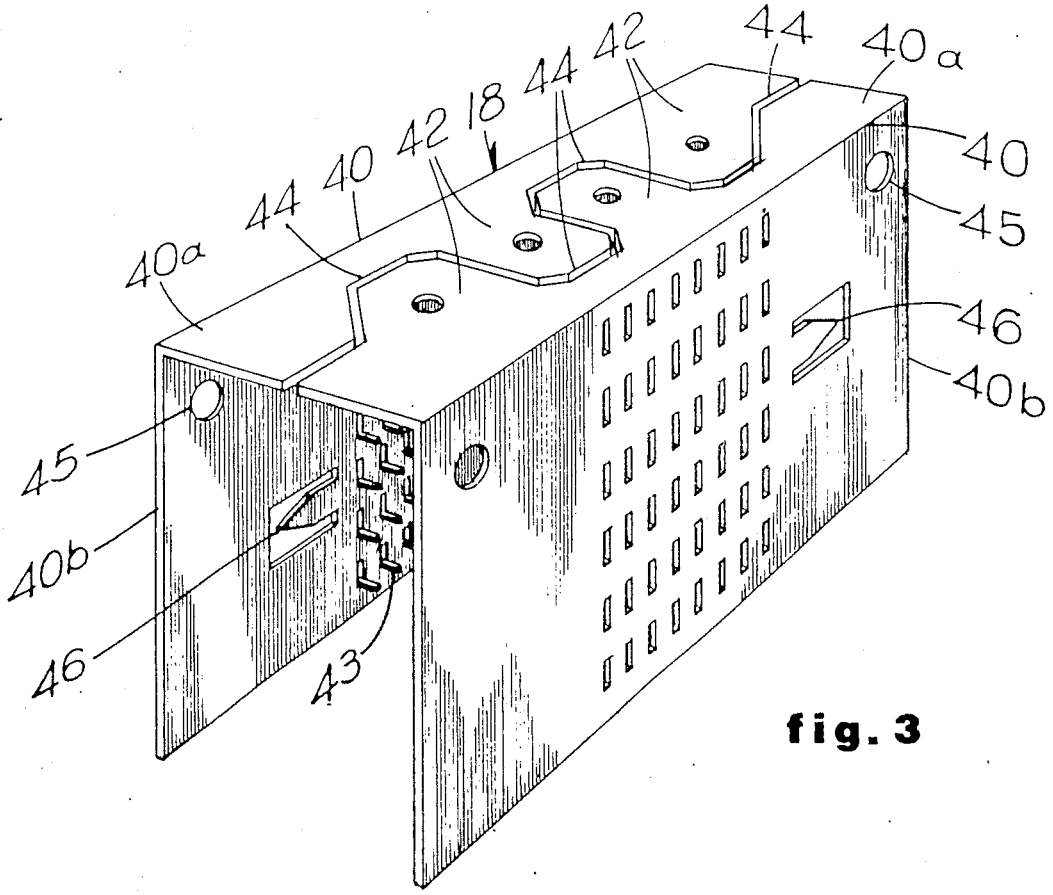
FIG. 3 is a perspective view of the second hinge pin support illustrated in FIG. 1 of the drawings.

Referring now to FIG. 3 of the drawings the hinge pin support member 18 is similar in construction to that described with reference to FIG. 2 of the drawings.

As in the previous example the member 18 comprises two parts 40 which are L-shaped in cross-section, the leg 40*a* being disposed at right angles to the leg 40*b* and extending lengthwise thereof.

The leg 40*a* is shorter than the leg 40*b*. Alternate projections and recesses 42 and 44 are provided in the leg 40*a* of each part 40, and as in the hinge member 16, the projections and recesses are arranged such that when the parts 40 are placed together as shown in FIG. 3 the projections in one part will engage in the recesses in the other part.

Thus the part 40 can be moved transversly relative to each other, but relative parallel movement will be prevented.

The length the leg 40*a* of each part 40 is such that when the parts are placed together as previously described the distance between the outer faces of the legs 40*b* will be less than the distance between the inner faces of the end portions of the member 16. A plurality of nail like projections 43 are formed in the central portion of the leg 40*a* of each member in the manner previously described whilst two holes 45 are formed in each leg 40*b*. The holes 45 are disposed one at each corner of the leg 40*b* adjacent to its junction with the associated leg 40*a*. Again as with the member 16, a tab 46 is formed in the leg 40*b* of each part 40, in the manner previously described and is disposed between the outermost line of nail like projections 43 and the hole 45 at that end of the part 40.

In order to pivotally connect the beams 10 and 12 together, a part 20 of the hinge member 16 is disposed with the leg 20*a* uppermost and the leg 20*b* directed downwardly. Then the tab 30 is bent inwardly of the part so as to project laterally and positioned so as to be located at the right hand end of the part as shown in FIGS. 1 and 2 with the tab 30 abutting the end face of the beam, and the leg 20*a* resting on the upper face of the beam 10.

The part 20 is then secured to beam by embedding the projections 26 in the beam 10.

The second part 20 is then placed on the beam 10 with its projections 22 engaged in the recesses 24 of the other part 20 and when so located it is secured to the beam by embedding its projections 26 in the beam. Thus because the parts 20 are identical the holes 28 at the right hand end of the parts will be in axial alignment and spaced beyond the end of the beam 10.

The hinge member 18 is then mounted on the end of the beam 12. This is effected by positioning one part 40 with its leg 40*a* horizontal and abutting the underside of the beam 12 and the leg 40*b* vertical, the tab 46 which is bent inwardly of the part so as to project laterally of the leg 40*b* and in the same direction as the leg 40*a*, abutting the end face of the beam. The part is then secured to the beam 12 by embedding the projections 43 in the beam.

It will be seen that the hole 45 in the part 40 is spaced beyond the end of the beam 12. The second part 40 is then placed on the beam 12, with its projections 42 engaged in the recesses 44 of the first member whereupon it is secured to the beam by embedding the projections 43 in the beam.

Again because the parts 40 are identical, the holes 45 at the left hand ends of the parts will be in axial alignment.

The beam 12 is then offered up to the beam 10, and the projecting end of the member 18 inserted into the projecting end of the member 16 until the holes 28 and 45 are aligned. The pivot pin 14 is then located in the holes and suitably retained therein.

Thus the two beams are pivotably connected together. It will be seen that in the preferred embodiment it is only necessary to accurately locate one part of each hinge pin support, the second part of each support locating itself relative to the first by means of the interengaging projections and grooves. It will also be seen that by correct selection of the horizontal spacing of the pivot pin holes and the tab when it projects laterally of the leg in which it is formed, will ensure that when the two members 16 and 18 can pivot relative to the other.

It will be appreciated that whilst in the above described embodiment the hinge members have been shaped for use with rectangular beams, other shapes can be employed. In addition the hinge members can be used on beams of varying width. In such a case, it is preferred that the projections and grooves do not become completely disengaged.

It will also be appreciated that whilst in the above described example the hinge pin supports are used in conjunction with wooden beams, the hinge can be used in conjunction with natural and man-made materials, which can be penetrated by nail like members.

What is claimed is:

1. An improved hinge support for supporting a hinge pin with respect to a piece of timber comprising:

first and second longitudinally extending generally L-shaped members, each member having (i) a first leg including a plurality of nail like projections which are directed so as to engage with said piece of timber;

(ii) a second leg including interengaging means extending along the longitudinal extent of each of the members for locating said first and second members relative to each other, wherein said interengaging means of said first member meshes with said interengaging means of said second member in a complementary manner to prevent longitudinal movement of said first member with respect to the second member while permitting transverse positioning of the members with respect to each other before the nail like projections are secured to the timber so that different size pieces of the timber may be accommodated therebetween; and (iii) means for holding said hinge pin near one extremity of said member.

2. The hinge support of claim 1 wherein said interengaging means comprise indentations and projections.

3. The hinge support of claim 2 in which both members are mirror images of one another.

4. The hinge support of claim 1 wherein each member has means for longitudinally locating said member relative to an extremity of said piece of timber.

5. The hinge support of claim 4 in which the means for locating said member comprises a tab which is located such that when it engages with said piece of timber, the means for holding said hinge are disposed beyond the extremity of said piece of timber.

6. The hinge support of claim 1 or 4 in which the end portions of the members each define between them a rectangular channel of greater cross-sectional area than the cross-sectional area between the center portions of the members.

7. An improved hinge for connecting two pieces of timber in an end-to-end relationship, said hinge comprising:

a first portion having first and second longitudinally extending generally L-shaped members, each member having (i) a first leg including a plurality of nail like projections which are directed so as to engage with said one piece of timber;

(ii) a second leg including interengaging means extending along the longitudinal extent of each of the members for locating said first and second members relative to each other, wherein said interengaging means of said first member meshes with said interengaging means of said second member in a complementary manner to prevent longitudinal movement of said first member with respect to the second member while permitting transverse positioning of the members with respect to each other before the nail like projections are secured to the timber so that different size pieces of the timber may be accommodated therebetween; and (iii) means for holding said hinge pin near one extremity of said members;

a second portion having first and second longitudinally extending generally L-shaped members, each member having (i) a first leg including a plurality of nail like projections which are directed so as to engage with said one piece of timber;

(ii) a second leg including interengaging means extending along the longitudinal extent of each of the members for locating said first and second members relative to each other, wherein said interengaging means of said first member meshes with said interengaging means of said second member in a complementary manner to prevent longitudinal movement of said first member with respect to the second member while permitting transverse positioning of the members with respect to each other before the nail like projections are secured to the timber so that different size pieces of the timber may be accommodated therebetween; and a hinge pin pivotally connecting the first portion to the second portion.

8. The hinge of claim 20 wherein said interengaging means of said first and second portions comprise indentations and projections.

9. A hinge as claimed in claim 8 in which both members are mirror images of one another.

10. A hinge as claimed in claim 21 in which the means for locating said members comprises a tab which is located such that when it engages with said one piece of timber, the means for holding said hinge are disposed beyond the extremity of said one piece of timber.

11. A hinge as claimed in claim 7 or 21, wherein said second portion is identical to said first portion.

12. A hinge as claimed in claim 7 wherein each member has means for longitudinally locating said member relative to the extremity of said one piece of timber.

13. A hinge as claimed in claim 9, 12, or 10 wherein said second portion is identical to said first portion.

14. A hinge as claimed in claim 7, or 12 in which the end portions of the members of said first portion each define between them a rectangular channel of greater cross-sectional area than the rectangular channel defined between the center portions of the members.

* * * * *